US008607463B1

(12) United States Patent
Stokes et al.

(10) Patent No.: US 8,607,463 B1
(45) Date of Patent: Dec. 17, 2013

(54) WOODWORKING PLANE USING UTILITY KNIFE

(76) Inventors: Ricky W. Stokes, Littleton, CO (US); Andrew James Stokes, Sheboygan, WI (US); Steve Scott Stokes, Madison, WI (US)

( * ) Notice: Subject to any disclaimer, the term of this patent is extended or adjusted under 35 U.S.C. 154(b) by 141 days.

(21) Appl. No.: 13/401,510

(22) Filed: Feb. 21, 2012

Related U.S. Application Data

(60) Provisional application No. 61/444,828, filed on Feb. 21, 2011.

(51) Int. Cl.
*B27G 17/02* (2006.01)

(52) U.S. Cl.
USPC ..... 30/478; 30/487; 30/488; 30/489

(58) Field of Classification Search
USPC ..... 30/478, 488, 487, 489, 484, 481, 48, 30/490
See application file for complete search history.

(56) References Cited

U.S. PATENT DOCUMENTS

| | | | | | |
|---|---|---|---|---|---|
| 1,484,861 | A | | 8/1922 | Basmaison | |
| 1,497,474 | A | | 6/1924 | Basmaison | |
| 1,587,746 | A | | 6/1926 | Basmaison | |
| 1,608,349 | A | * | 11/1926 | Tvedt | 30/493 |
| 2,636,529 | A | | 4/1953 | Miltenburg | |
| 2,648,366 | A | | 4/1953 | Weber | |
| 2,781,804 | A | | 4/1955 | Wilson et al. | |
| 2,719,554 | A | | 10/1955 | Kromer | |
| 2,839,109 | A | * | 6/1958 | Wilson et al. | 30/478 |
| 2,912,843 | A | | 4/1959 | Williams | |
| 3,027,641 | A | | 11/1960 | Leonardson | |
| 3,028,892 | A | * | 4/1962 | Filia | 30/487 |
| 3,120,250 | A | | 2/1964 | Dakin | |
| 4,088,165 | A | * | 5/1978 | Andersson | 30/478 |
| 4,492,260 | A | * | 1/1985 | Whiteford | 30/478 |
| 4,589,209 | A | * | 5/1986 | Zarges et al. | 30/478 |
| 5,005,709 | A | | 4/1991 | Stokes | |
| 8,424,214 | B2 | * | 4/2013 | Vanderbeek et al. | 30/488 |
| 2004/0068878 | A1 | * | 4/2004 | Lin | 30/481 |
| 2007/0044328 | A1 | * | 3/2007 | Economaki | 30/478 |

* cited by examiner

*Primary Examiner* — Ghassem Alie
(74) *Attorney, Agent, or Firm* — Patent Law Offices of Rick Martin, P.C.

(57) ABSTRACT

A block plane uses a standard utility knife blade mounted at about a 40° angle so the edge of the blade runs parallel to the side of the main body. The blade is set angled to the longitudinal axis of the plane. A snap on plastic grip holds extra blades inside. Cuts of ten thousands of an inch are made, and buying different thicknesses of the disposable blades varies the cut slightly. Most utility knife blades are about 0.025 inches thick.

10 Claims, 6 Drawing Sheets

WOODWORKING PLANE USING UTILITY KNIFE

CROSS REFERENCE APPLICATIONS

This is a non-provisional application claiming priority from provisional application No. 61/444,828 filed Feb. 21, 2011, cross reference patent.

FIELD OF INVENTION

The present invention relates to providing a block plane that uses off the shelf utility blades instead of custom blades.

BACKGROUND OF THE INVENTION

Related patents include U.S. Pat. No. 2,781,804 (1974) to Wilson et al. A double edge razor blade is used as the disposable blade. Although inexpensive, these blades are very fragile. U.S. Pat. No. 2,648,363 (1953) to Weber discloses a plane using a single edge razor blade. Although inexpensive, these blades are very fragile. U.S. Pat. No. 2,636,529 (1953) to Miltenburg discloses a plane holding a razor blade scraper. The replaceable blade is very fragile. U.S. Pat. No. 1,497,474 (1924) to Basmaison discloses a custom blade plane. U.S. Pat. No. 2,719,554 (1955) to Kromer discloses a single edge razor blade plane. The blade is fragile. All the above inventions mount the blade at a 90° angle to the longitudinal axis of thee plane.

The woodworking plane has a long history. Woodworking planes are tools containing a sharp blade and are designed to be manually slid against the face or edge of a piece of wood thereby removing a thin shaving as each pass is made. A woodworking plane can be manufactured to be any length. Block planes are normally about 4 to 7 inches long. Smoothing planes are from 5½ to 10 inches long. Jack planes are from 11½ inches to 15 inches long. Jointer planes are from 18 to 24 inches long. Until a few years ago all planes had to be expertly sharpened and adjusted. In recent time several plane manufactures have started producing woodworking planes that have a replaceable and disposable razor-like cutting edges. Example include the Roli Hand Plane Model 220 Pro or 105 Pro. The replacement blade cost $19.95. These replaceable blades are all custom made to fit each particular brand and model of tool. These custom blades are not commonly available at retail outlets, and usually need to be specially ordered. These custom blades are not as expensive as older iron plan blades, however, they are not nearly as inexpensive as generic utility knife blades. Utility knife blades cost about ten cents. The Stanley™ 12-105 RBS only costs $14.95 retail with the custom blade. All of these disposable blade planes require expert positioning of the blade in order to be properly used.

The common utility knife blade has become a worldwide generic item that is manufactured by many companies. Examples include the Stanley Black and Decker™ Fat Max blade model 11-780 and regular duty model 11-911, and the Irwin™ blade model 2084100. Other than small differences in thickness or metal formulations-all these blades are the same dimension, and shape. A blade from any manufacturer will fit nearly any knife-like tool made by any other manufacturer for use with these generic utility blades. The present invention woodworking plane will accept these generic utility knife blades made by any manufacturer. Making use of these generic utility knife blades which can cost from as little as 10 cents each can be a considerable saving when compared to purchasing custom made razor-like blades. Even a novice craftsman can now easily install an inexpensive, and sharp new cutting edge in his plane. These generic utility knife blades are quite inexpensive and tough. These blades can be purchased at virtually all hardware stores and lumberyards. The blades are available in carbon steel, tough bi-metal, or even serrated edge configurations.

The present invention holds a generic utility knife blade at the exact angles necessary to make this generic utility knife blade useful in a woodworking plane.

Another unique feature of the plane design is that it requires no adjustments. The blade is inserted into a tightly indexed pocket and clamped into place. The pocket is preset at the factory so that the depth of cut is the same each and every time the operator installs a new generic utility knife blade. The design concept of the invention is to manufacture various models of planes each having different lengths and widths. All of these planes will accept a generic utility knife blade for use as its cutting edge. In this particular model of plane the blade is mounted in a skewed position resulting in a smoother cut. This skewed blade angle requires less operator effort. This plane is simple and inexpensive to manufacture. This plane includes a cavity in which to store extra blades. This plane is constructed of only three basic parts (main body, clamp plate, and grip) making it inexpensive to manufacture.

SUMMARY OF THE INVENTION

The main aspect of the present invention is to provide a plane that uses a standard utility knife blade for cutting.

Another aspect of the present invention is to provide a non-adjustable blade mount.

Another aspect of the present invention is to provide for a mount that is angles at a range of about 35° to about 45° to the longitudinal axis of the plane, and angled up from the horizontal at a range of 15 to 25 degrees.

Another aspect of the present invention is to provide a blade storage compartment in the handle.

Another aspect of the present invention is to provide a single knob bolt to hold the clamp plate in place.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
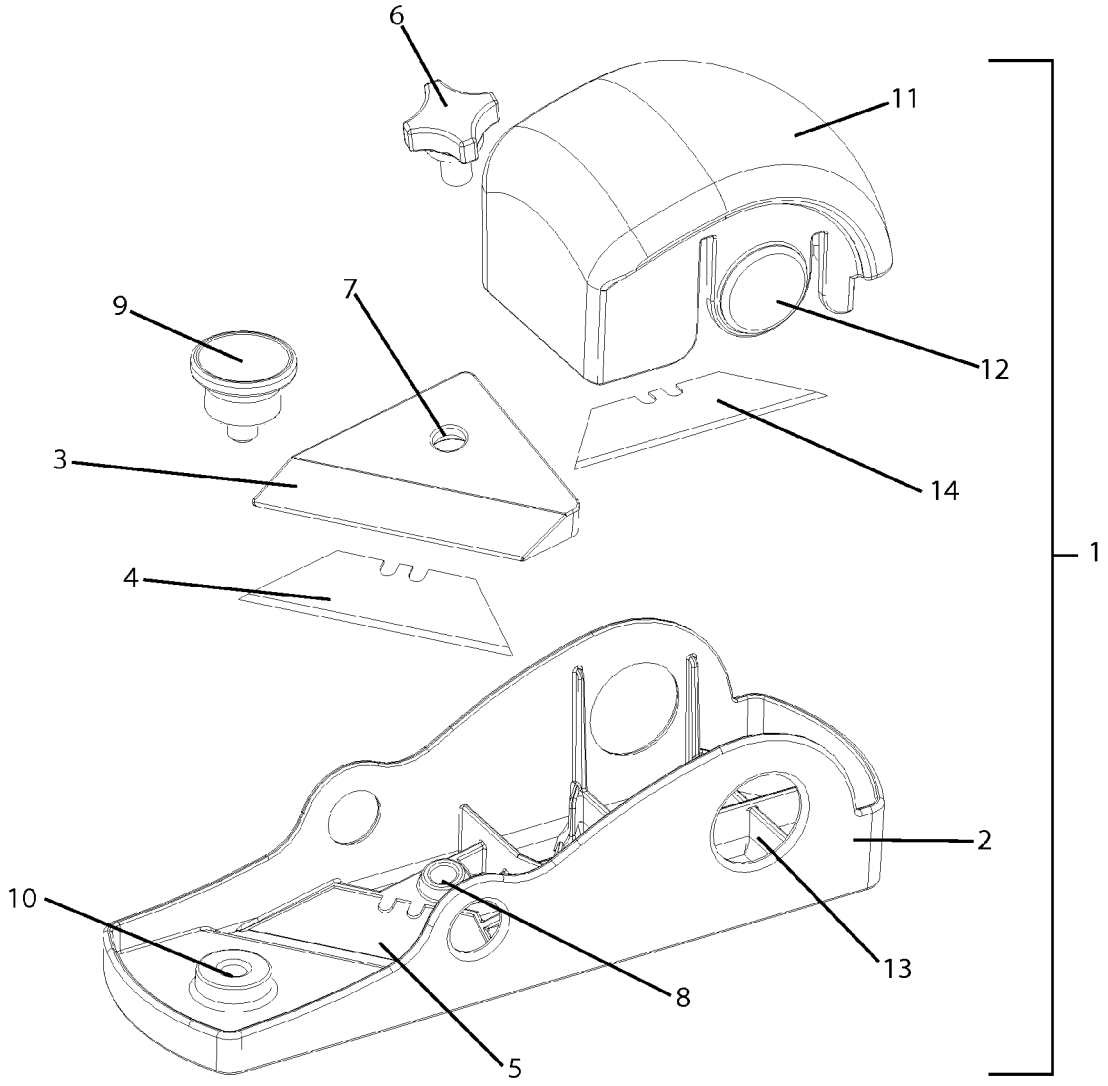
FIG. 1 is a exploded view of the block plane.
Figure 9:
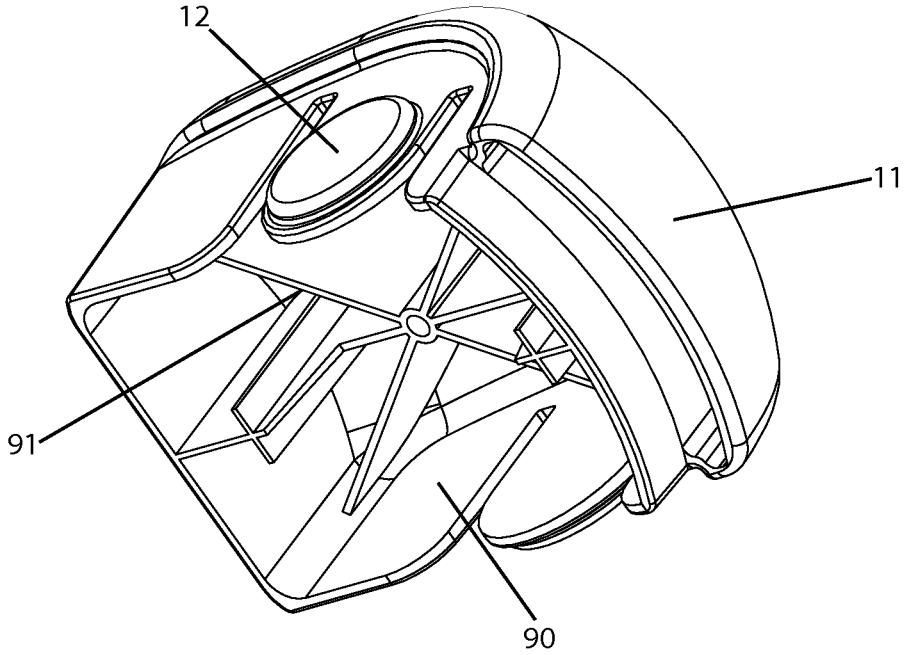
FIG. 9 is a bottom perspective view of the handle.

Referring first to FIG. 1 a block plane 1 has a main body 2 preferable made of cast iron or steel, die cast zinc, aluminum, or molded plastic. A clamp plate 3 secures a utility blade 4 on a cradle 5. A clamp knob 6 passes through hole 7 in clamp plate 3 and then screws into threaded hole 8 in the main body 2. A steering knob 9 fastens into the main body 2 at hole 10. A plastic grip 11 has mounting buttons 12 that snap fit into holes 13 on the main body 2. The grip 11 is hollow to form a storage compartment 90 shown in FIG. 9. Extra blades 14 fit in the storage compartment 90.

Figure 2:
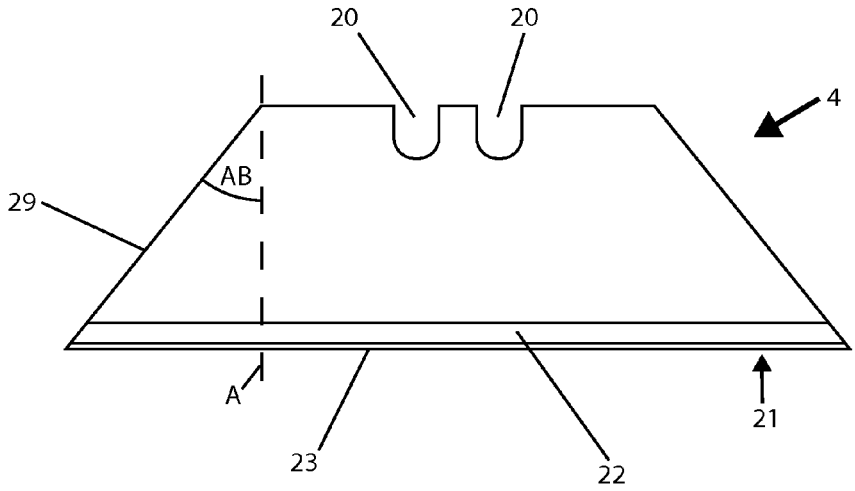
FIG. 2 is a top plan view of a standard utility blade.

In FIG. 2 details of standard utility blade 4 are shown. Notches 20 are used in plane 1. To mount against bosses B1, B2 of cradle 5, see FIG. 7. The blade tip 2, has a grinding process ledge 22 and a working ledge 23 made with a honing process.

Figure 3:
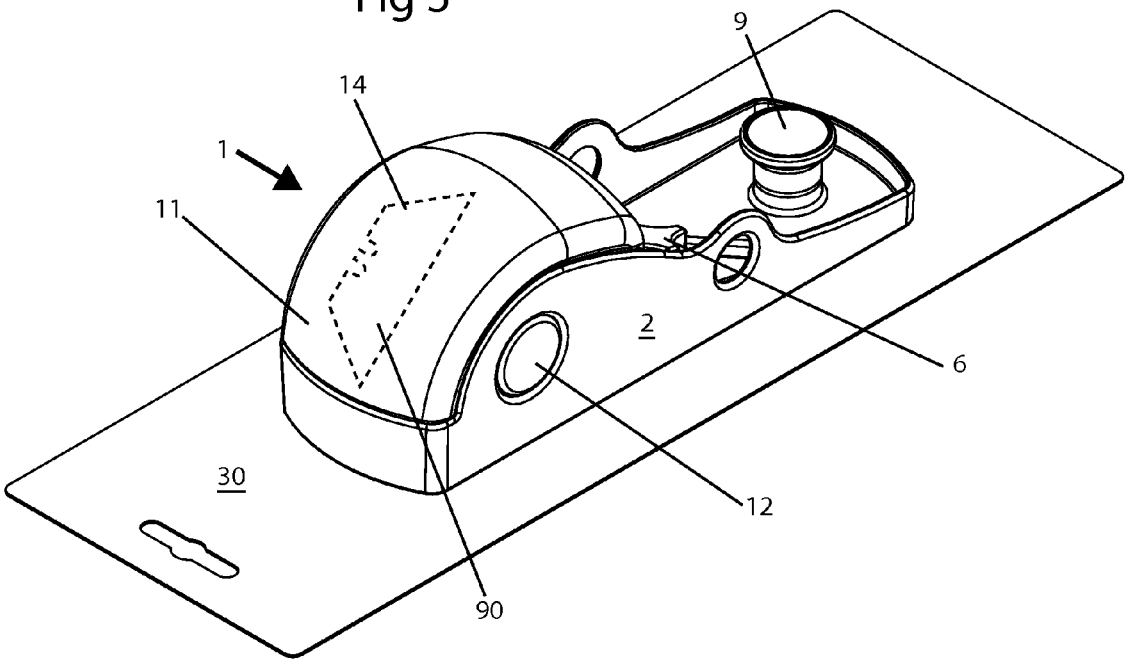
FIG. 3 is a top perspective view of the block plane.

Referring next to FIG. 3 a clam shell packaging base 30 holds the block plane 1. The mounting buttons 12 can be pressed to release the grip 11 and access the blades 14.

Figure 4:
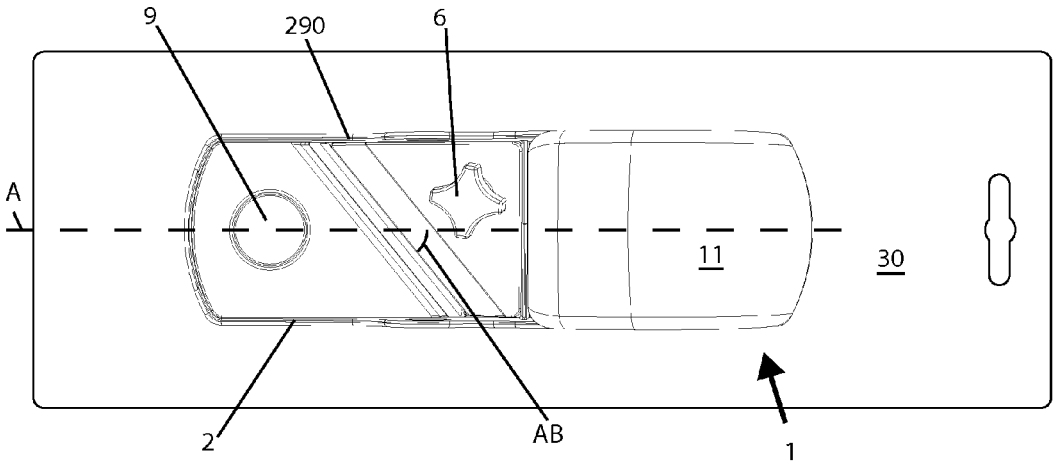
FIG. 4 is a top plan view of the block plane.

In FIG. 4 the angle of the blade AB relative to the longitudinal axis A of the main body 2 can be between 35-45% usually 40°. See how this angle matches the corresponding angle AB on blade 4 in FIG. 2. Thus, edge 29 of blade 4 aligns with edge 290 of main body 2.

The cut of the blade 4 is about ten thousands of an inch with no adjustments. However, one skilled in the art could provide an adjustable blade mount. Blades with varying widths in the range of 0.025 inch can be mounted to provide different cut depths.

Figure 5:
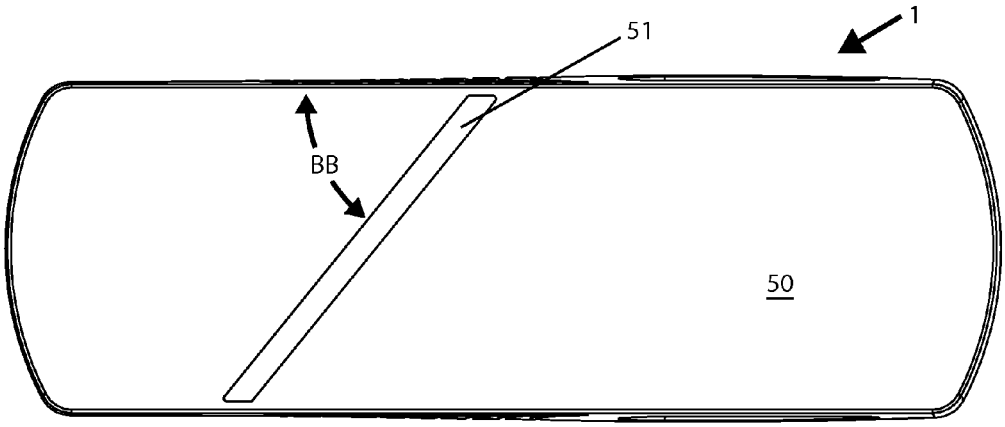
FIG. 5 is a bottom plan view of the block plane.

Referring next to FIG. 5 the main body 2 has a bottom 50. The blade shot 51 is 0.151 inch wide with angle BB at 51.0°

Figure 6:
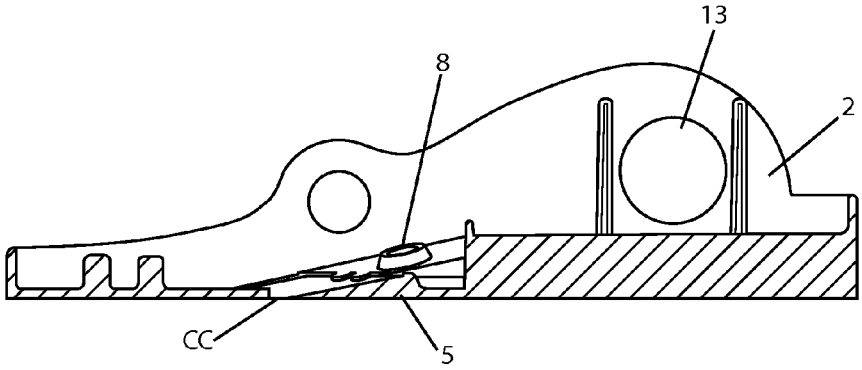
FIG. 6 is a longitudinal sectional view of the main body of the block plane.
Figure 7:
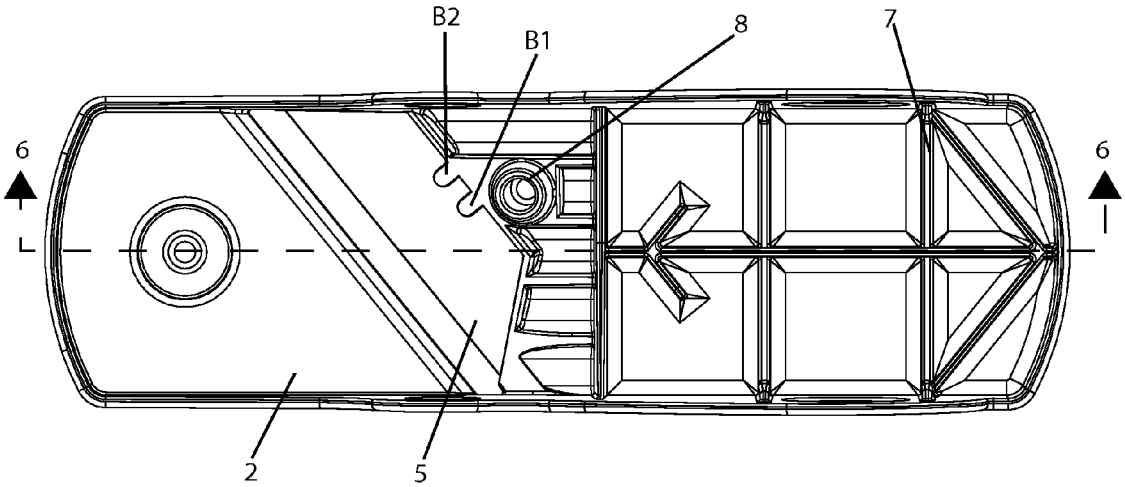
FIG. 7 is a top plan view of the main body of the block plane.

Referring next to FIGS. 6, 7 the cradle 5 upward slope angle cc is 11.8°. Ridges 70 support the bottom 91 ridges of the grip 11, see FIG. 9. Hole 8 is level with cradle 5. Bosses B1, B2 in the cradle fit into the slots at the rear of the utility knife blade.

Figure 8:
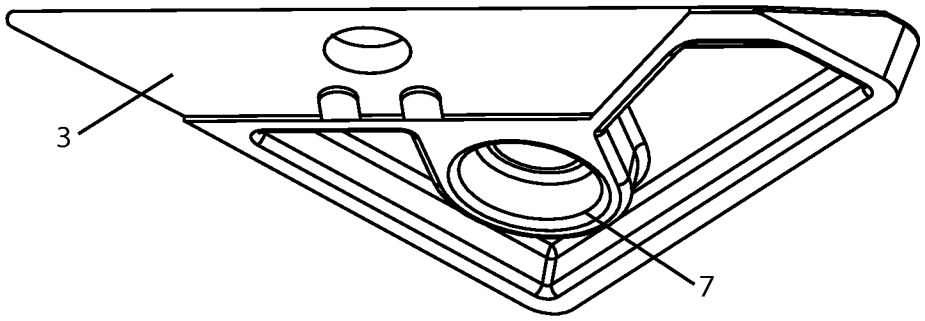
FIG. 8 is a bottom perspective view of the clamp plate.

In FIG. 8 the clamp plate is preferably metal.

Figure 10:
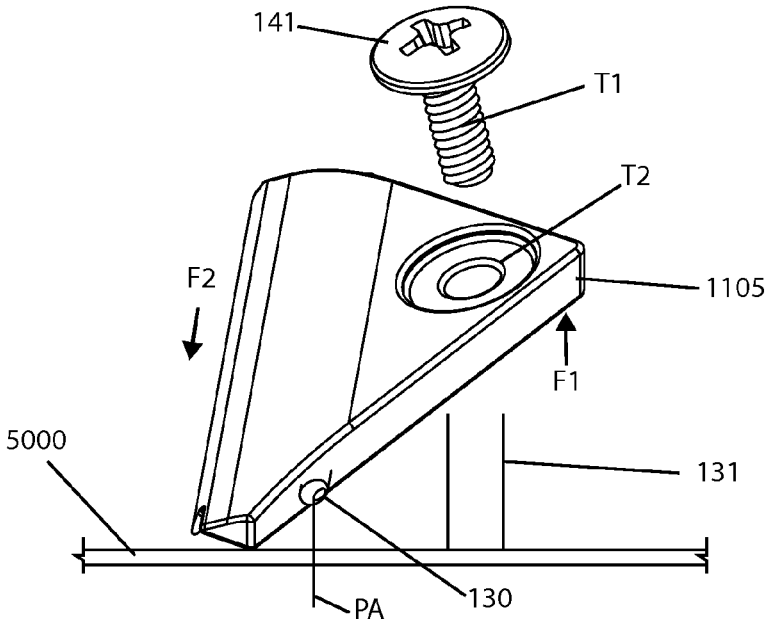
FIG. 10 is a side perspective view of an alternate embodiment clamp plate.
Figure 11:
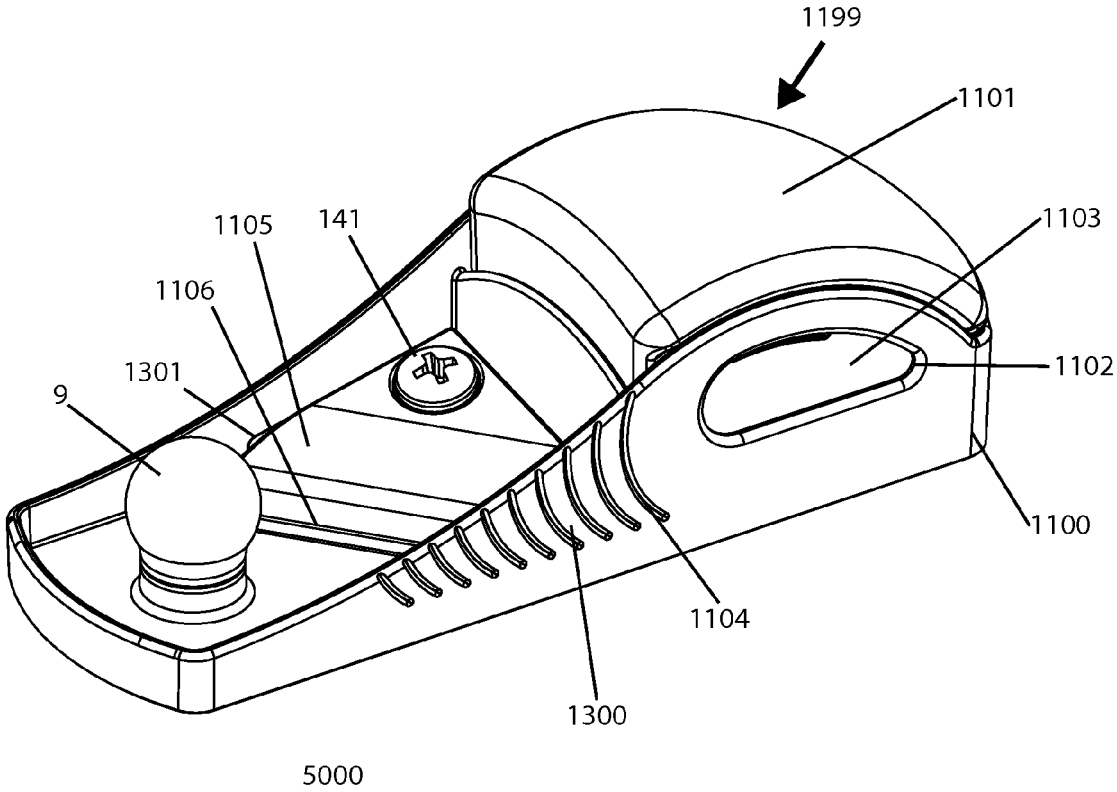
FIG. 11 is a side perspective view of an alternate embodiment block plane with the FIG. 10 clamp plate.

Referring next to FIGS. 10, 11 a plane 1199 features a pivoting clamp plate 1105. The bottom 5000 of the main body 1100 does not have a threaded hole 8 as does bottom 500 shown in FIG. 7. The main body 1100 has side panel holes 1300, 1301 which receive pivot knobs 130, one on each side of the clamp plate 1105. Thus, a pivot axis PA is formed. A phillips lead top 141 on bolt 131 tightens threads T1 through receiving female threads T2 in the clamp plate 105. The bottom of bolt 131 is forced down onto bottom 5000. Thus, and upward force F1 is applied to the rear of the clamp plate 1105, and a downward force F2 is applied to the front of the clamp plate 1105 against the working front edge 1106 of the standard utility blade.

The main body 1100 has grip ridges 1104 and an oval receiving hole for plastic side supports 1103 of the grip 1101.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A block plane comprising:

a main body having a generally rectangular shaped base with a front end and a rear end;

said front end having a knob for grasping;

said rear end having a left and a right wall forming a blade storage compartment;

a grip snap fitted between the left and the right walls;

said main body having a flat bottom with one razor sized slot located near the front end;

said slot having an angular orientation relative to a parallel left and right side of the main body;

a cradle on a top forward segment of the base;

said cradle shaped to secure a utility knife blade, having a width of about 2.41 inches, at a front to rear angle of about 12 degrees, wherein said utility knife blade is secured to have its blade protruding through the slot a distance in the range of 10/1000 to 25/1000 inch;

said utility knife blade having two mounting slots along a rear non-working edge thereof which fit into a pair of bosses in the cradle;

a clamp plate secured by a bolt over said blade;

wherein said utility blade is secured in one non-adjustable position in the cradle by the clamp plate and bolt; and wherein said utility blade can be replaced by loosening said bolt and removing the clamp plate.

2. The block plane of claim 1, wherein the main body is made of metal and the grip is made of plastic.

3. The block plane of claim 2, wherein the angular orientation of the slot ranges between 35° and 55°.

4. The block plane of claim 3, wherein said main body has a length ranging from 6 to 7 inches.

5. The blade clamp of claim 1, wherein the knob at the front end has a bolt end threaded into the bottom.

6. A block plane comprising:

a main body having a generally rectangular shaped base with a front end and a rear end;

said front end having a knob for grasping;

said rear end having a left and a right wall forming a blade storage compartment;

a grip snap fitted between the left and the right walls;

said front end having a left and a right pivot brace;

said main body having a flat bottom with one razor sized slot located near the front end;

said slot having an angular orientation relative to a parallel left and right side of the main body;

a cradle on a top forward segment of the base;

said cradle shaped to secure a utility knife blade, having a width of about 2.41 inches, at a front to rear angle of about 12 degrees, wherein said utility knife blade is secured to have its blade protruding through the slot a distance in the range of 10/1000 to 25/1000 inch;

said utility knife blade having two mounting slots along a rear non-working edge thereof which fit into a pair of bosses in the cradle;

a clamp plate secured by its left and right pivot knobs which pivotally mount in their respective left and right pivot brace;

said clamp plate having a rear hole with threads;

a bolt threaded thru the threads of the rear hole so as to press a bottom of the bolt against a top surface of the flat bottom;

wherein tightening the bolt creates downward force on a front edge of the clamp plate via the pivot knobs;

wherein said utility blade is secured in one non-adjustable position in the cradle by the clamp plate and bolt; and wherein said utility blade can be replaced by loosening said bolt and removing the clamp plate.

7. The block plane of claim 6, wherein the main body is made of metal and the grip is made of plastic.

8. The block plane of claim 7, wherein the angular orientation of the slot ranges between 35° and 55°.

9. The block plane of claim 8, wherein said main body has a length ranging from 6 to 7 inches.

10. The blade clamp of claim 6, wherein the knob at the front end has a bolt end threaded into the bottom.

* * * * *